United States Patent [19]

Rosene

[11] Patent Number: 4,587,953

[45] Date of Patent: May 13, 1986

[54] SWEETENER SOLUTION PURIFICATION PROCESS

[75] Inventor: Michael R. Rosene, Pittsburgh, Pa.

[73] Assignee: Calgon Carbon Corporation, Pittsburgh, Pa.

[21] Appl. No.: 647,002

[22] Filed: Sep. 4, 1984

Related U.S. Application Data

[63] Continuation of Ser. No. 441,458, Nov. 15, 1982, abandoned, which is a continuation-in-part of Ser. No. 393,211, Jun. 28, 1982, abandoned.

[51] Int. Cl.[4] ..... C13D 3/14

[52] U.S. Cl. ..... 127/46.2; 127/55; 426/271

[58] Field of Search ..... 426/271, 490; 127/46.2, 127/55

[56] References Cited

U.S. PATENT DOCUMENTS

| | | | |
|---|---|---|---|
| 2,763,580 | 9/1956 | Zabor | 127/55 |
| 3,784,409 | 1/1974 | Nelson et al. | 127/46.2 |
| 4,329,183 | 5/1982 | Rousseau et al. | 127/46.2 |

*Primary Examiner*—George Yeung

*Attorney, Agent, or Firm*—Reed, Smith, Shaw & McClay

[57] ABSTRACT

An improved process for purifying sweetener solutions is described. This process features passing crude sweetener solution through a series of adsorption materials, preferably arranged in the following order; cation exchange resin, microporous adsorbent, anion exchange resin.

14 Claims, 5 Drawing Figures

Refining Flowsheet For HFCS Plant

D
E
Conductance (micromhos)
160
140
120
100
80
60
40
20
0
200
400
600
800
1000
1200
1400
1600
1800
2000
Volume Treated (ml's)

SWEETENER SOLUTION PURIFICATION PROCESS

CROSS REFERENCE TO RELATED APPLICATION

This is a continuation of application Ser. No. 441,458, filed Nov. 15, 1982, now abandoned, which is a continuation-in-part of application Ser. No. 393,211, filed June 24, 1982, now abandoned.

BACKGROUND OF THE INVENTION

Ion-exchange resins may be poisoned by the adsorption of substances that are either very difficult to remove or are very easily removed from the polymeric structure of the resin. A guard chamber containing activated carbon has been employed for the protection of an anion exchange resin column used in the purification of uranium values. This system operates in a pH range of 5–10. See, U.S. Pat. No. 4,296,075.

Cation and anion exchange resin pairs (or systems) are used extensively in the purification of sweetener solutions, for example, corn syrups, cane syrups, beet syrups and in other sweetener applications. These ion-exchange resin systems are especially useful in purifying dextrose syrups for the production of high fructose corn syrups (HFCS). These resins are employed for the removal of ash, specifically conductometric ash as measured by the beverage industry. A key cause of unwanted syrup conductance is the presence of salts resulting from neutralization reactions during the processing of the syrup. While the cation and anion exchange resins are effective in removing these salts, other components present in crude sweetener solution also contribute to this undesirable syrup conductivity. These other components are generally weak organic acids, generated by the breakdown of starches or proteins. These acids include citric, glutamic, lactic, tartaric and others. Generally, the specific acids are not identified. Rather, the mixture of acids in the syrup are termed "titratable acidity". These weak organic acids are removed by the anion exchange resin as negatively charged organic anions. However, due to the low charge density of some of these acids, they are easily displaced from the anion exchange resin. This results in an early rollover of the organic acids from the anion exchange resin causing an unacceptable rise in syrup conductance. This rollover or bleed of organic acids into the syrup triggers a need for regeneration of the anion exchange resin before it has been fully utilized. Others of these acids will not be readily displaced and will occupy exchange sites which are then unavailable to the inorganic ash constituents thereby also shortening the useful resin cycle. Such exchange resin system downtime is wasteful both from a processing (time) standpoint and an economic standpoint.

It has been discovered, that the ion-exchange system downtime can be reduced, and hence, overall process efficiency increased, if the weak undissociated acids in the sweetener syrup are removed before they enter the anion exchange resin. These acids are adsorbed on a properly positioned microporus adsorbent within the ion exchange resin system.

SUMMARY OF THE INVENTION

Under low pH conditions present in a sweetener purification process, the weak organic acids contributing to the titratable acidity of the syrup can be removed from the system by a microporous adsorbent. From this discovery, it has been theorized that numerous other applications are possible for the use of microporous adsorbents such as activated carbon for the protection of ion exchange resins. These other applications are described in greater detail herein below.

Thus there is provided an improved sweetener solution purification process which comprises: (a) passing crude sweetener solution through a bed containing a cation exchange resin, thereby lowering the syrup pH; (b) passing the effluent of said cation exchange resin through a bed containing a microporous adsorbent, thereby adsorbing weak organic acids contributing to titratable acidity; and (c) passing the effluent from said microporous adsorbent through a bed containing an anion exchange resin.

BRIEF DESCRIPTION OF THE DRAWINGS

FIG. 11 details one embodiment of the present invention, namely the placement of a microporous adsorbent (MPA) between the cation-anion exchange resin pair used to purify sweetener solutions. The solid lines represent conventional solution flow directions, the broken lines show alternative flow directions.

FIG. III is a conductance breakthrough curve showing improved ion exchange resin system performance for carbon treated dextrose syrup (curve B) over untreated dextrose syrup (curve A).

FIG. IV is a conductance breakthrough curve showing improved ion exchange resin system performance for regenerated carbon treated dextrose syrup (curve C) over virgin carbon treated syrup (curve B) over untreated syrup (curve A).

FIG. V is a conductance breakthrough curve showing improved ion exchange resin system performance for carbon treated fructose syrup (curve E) over untreated fructose syrup (curve D).

DETAILED DESCRIPTION OF THE INVENTION

The present invention involves the use of a microporous adsorbent in a sweetener solution refining process to protect the anion resin of the cation-anion exchange resin system. The terms "sweetener solution" are intended to include those crude sugar solutions recognized in the art as common "sweeteners", for example, corn syrup, cane syrup, beet syrup, high fructose syrup, high dextrose syrup, sorbitol and the like. The terms "microporous adsorbent" are intended to include those common adsorbents having microporous intersticies (pore volume) of more than 0.1 cc/gram in pores of 100 A or less, including activated carbon, alumina, silica, Ambersorb type macrorecticular resins, zeolites, microporous clays and the like. The preferred microporous adsorbent is activated carbon. Activated carbon may be employed in any convenient form, granular, powder, or a mixture of both, and said carbon may be acid washed.

It has been discovered that the acids which contribute to titratable acidity in crude sweetener solutions are effectively adsorbed by microporous adsorbents such as activated carbon when in the undissociated form. To obtain a high degree of undissociated acids, a pH of from about 2 to 2.5 is necessary. Two locations in a sweetener solution purification process where pH is this low are (1) within the cation exchange resin bed and (2) directly following the cation exchange resin bed, including for a short time within the anion exchange resin bed. Other sweetener solution impurities, some of which are generated in the cation resin bed, such as proteins, hydroxy methyl furfuryl, fragments of the cation resin and unidentified organics not contributing to titratable acidity, are rendered less soluble at low pH and will also be adsorbed by a properly positioned microporous bed.

Figure 1:
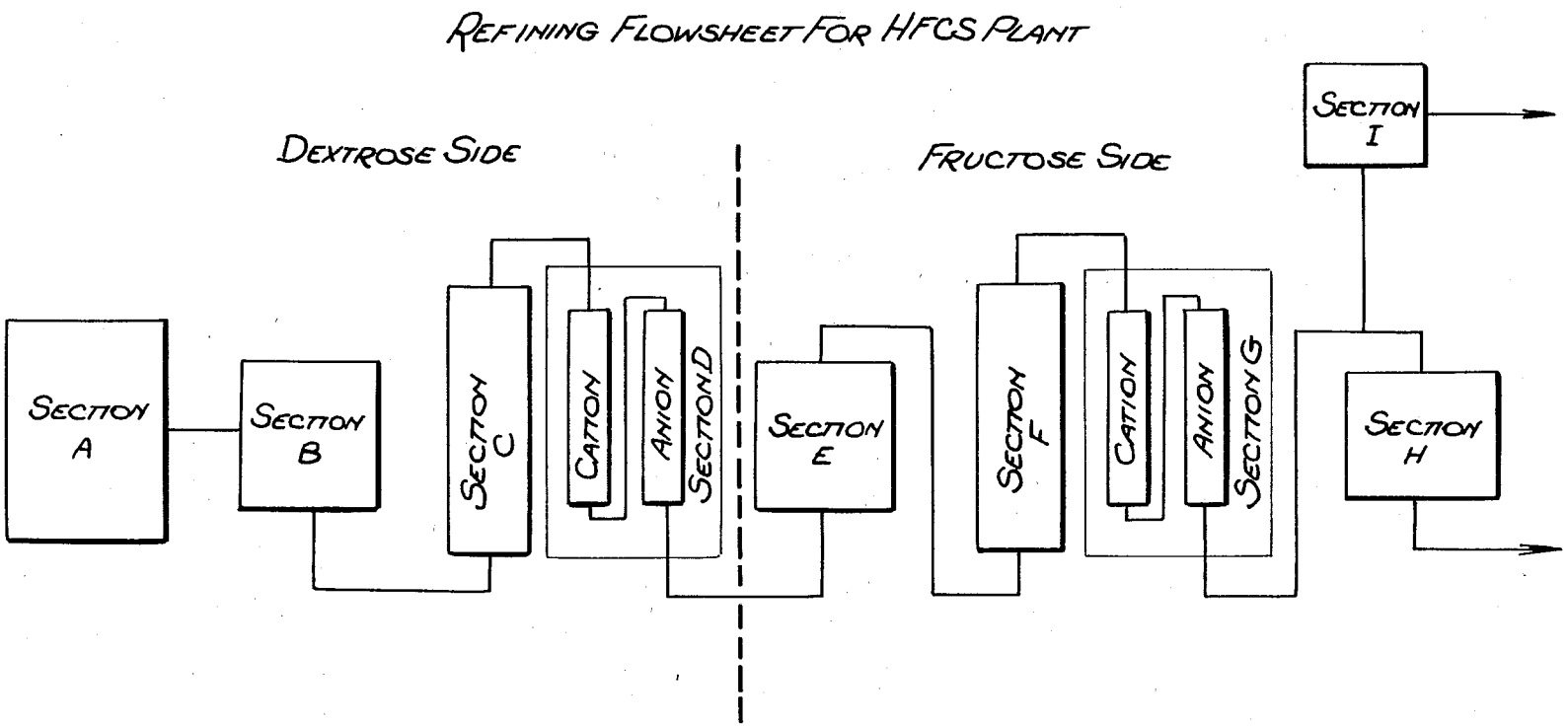
FIG. 1 describes a conventional process scheme for generating high fructose corn syrup (HFCS). Sections A–D represent the dextrose side and Sections E–I represent the fructose side.
Figure 2:
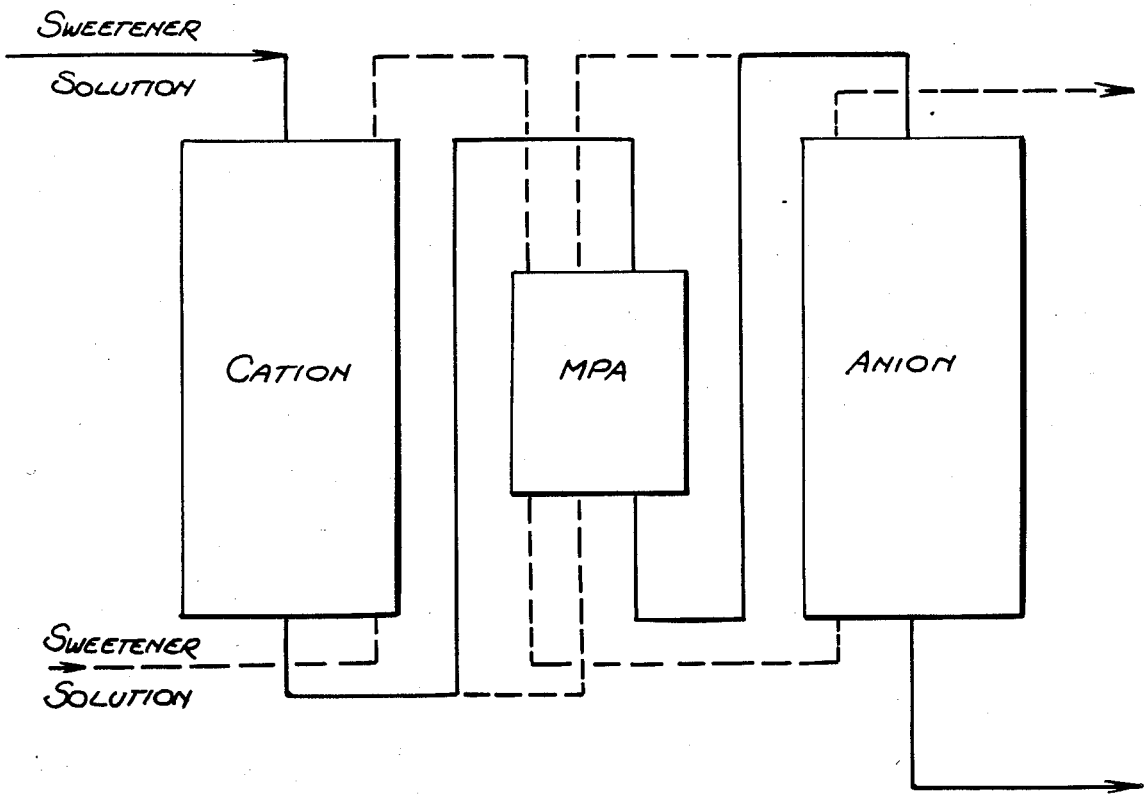
Figure 3:
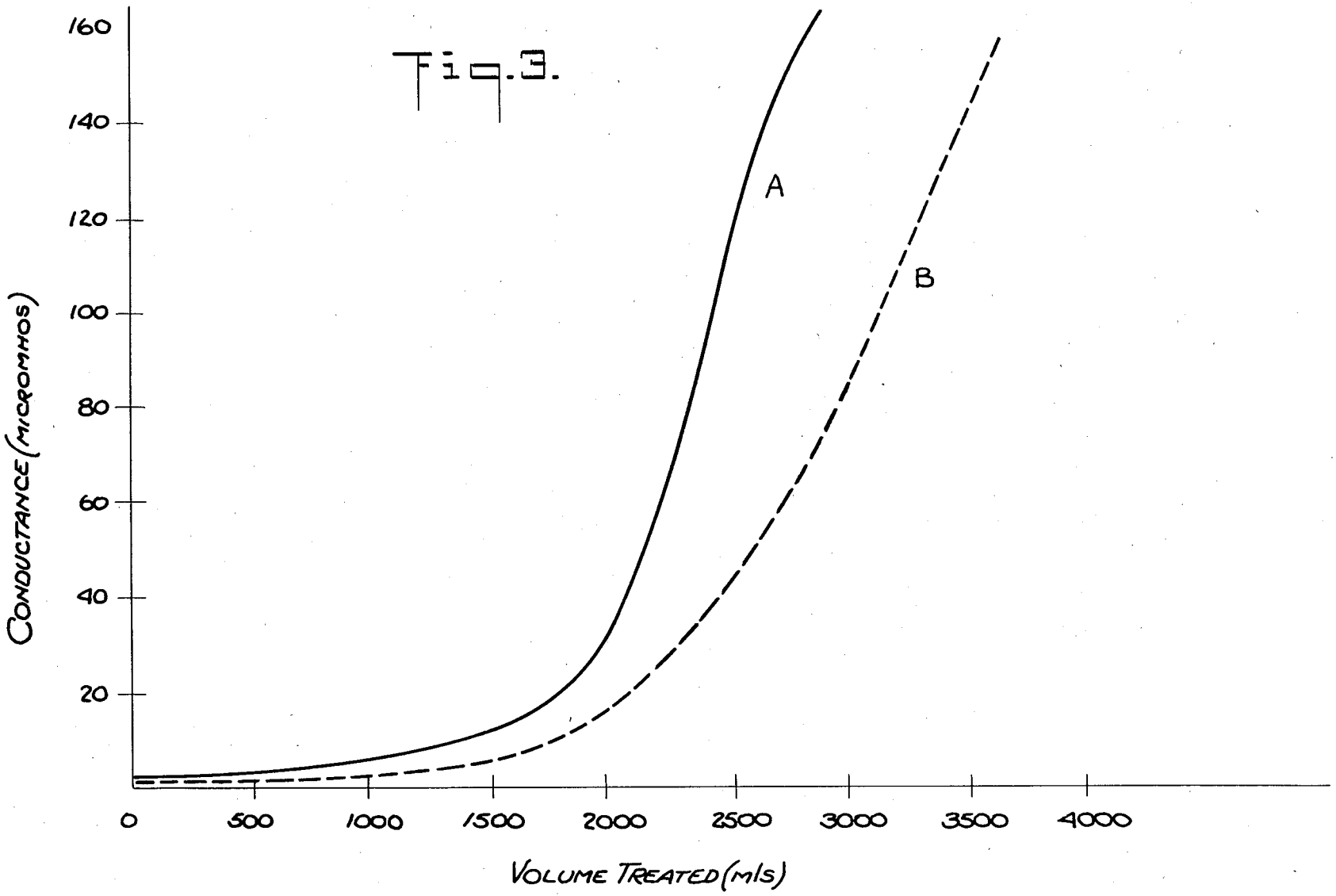
Figure 4:
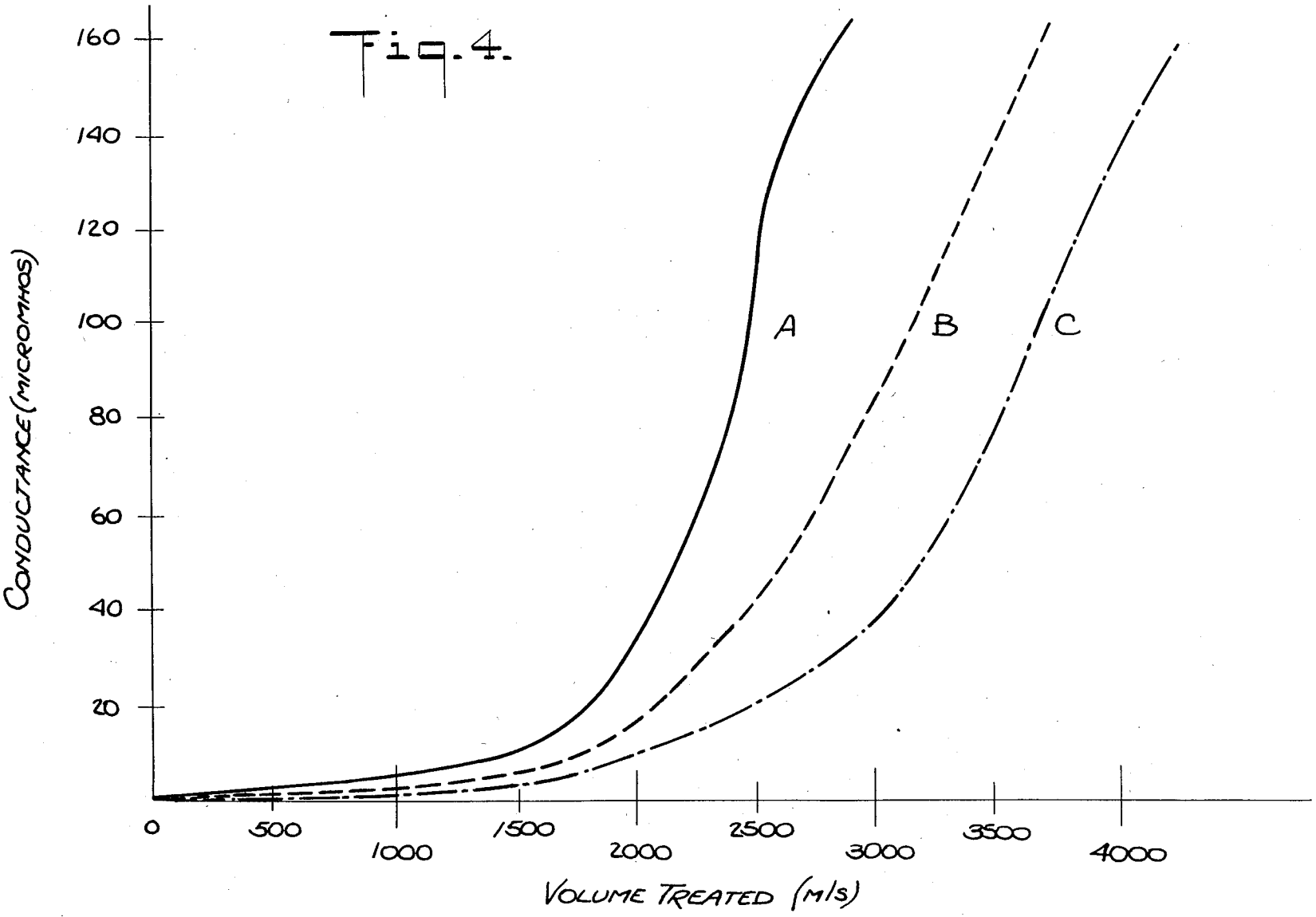
Figure 5:
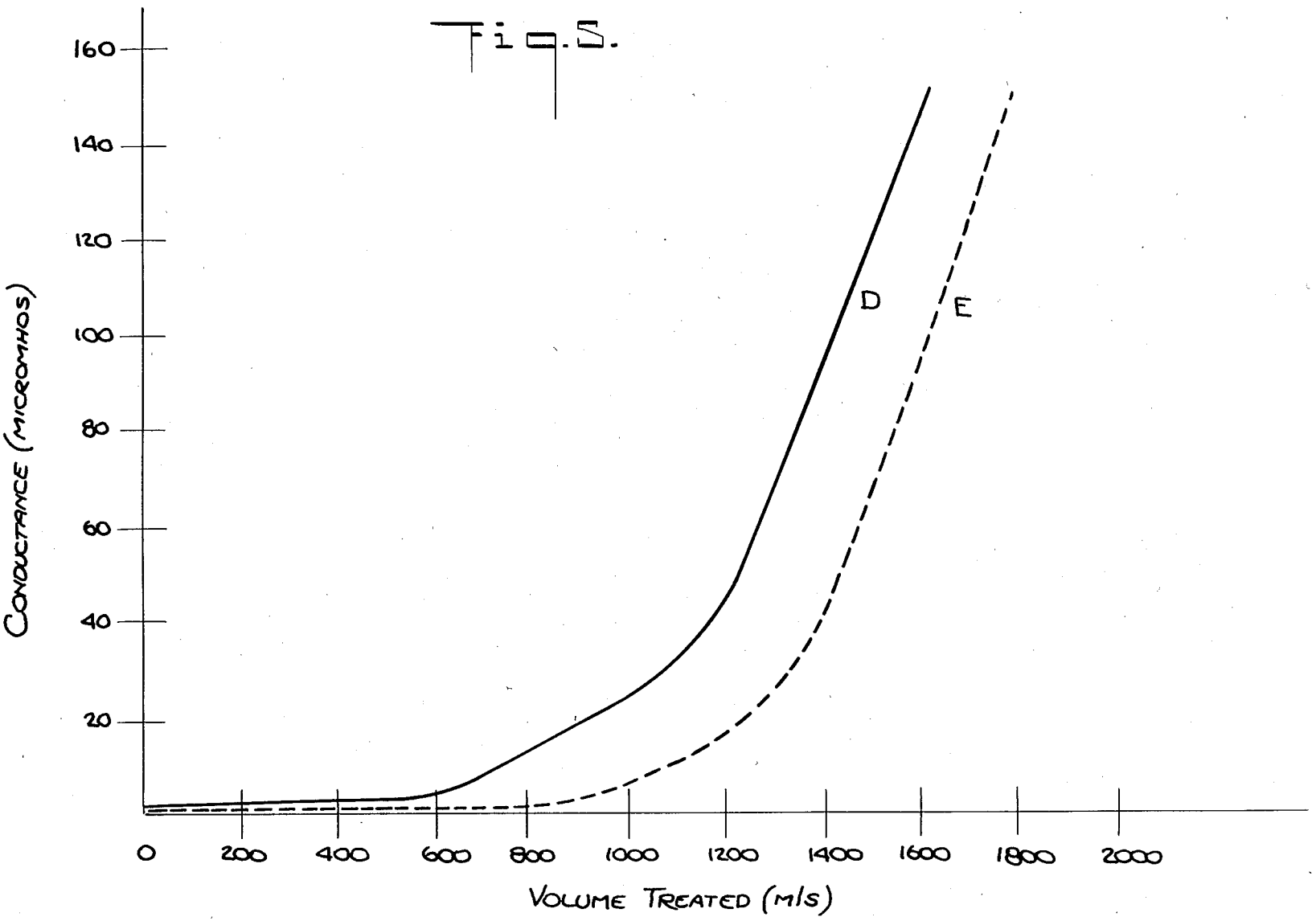

A conventional high fructose corn syrup purification process is described in FIG. 1. The process is generally divided into two areas; dextrose purification and fructose purification. While this general description is directed to a column operation, it is anticipated that a batch processing operation will derive a similar benefit from the present invention.

Referring to FIG. 1 in detail, raw materials are ground into a pulp, are washed and starches are separated (Section A). This is followed by conversion of the crude materials either by chemical conversion (acid) or by enzymatic conversion of the starch slurry to a high dextrose equivalent syrup (Section B).

The dextrose syrup is passed through a column of activated carbon (Section C) for decolorization and removal of some impurities. The syrup pH at this point is about 3.5–5.0 and it has been found that many weak organic acids contributing to titratable acidity are not effectively adsorbed by this activated carbon.

The carbon treated syrup passes next to the cation-anion exchange system (Section D) wherein first a cation and second an anion exchange resin remove salts and other impurities. The syrup exiting the cation exchange resin has a pH below 3.0 (preferably 2.5 or less). The syrup exiting the anion exchange resin has a pH of from 3.5 to 5.0. The use of a microporous adsorbent in this ion exchange system would delay the organic acid rollover from the anion exchange resin and thus improve the overall process efficiency.

The purified dextrose syrup is then converted into high fructose corn syrup (HFCS) by enzymatic conversion (Section E).

Activated carbon is again employed to decolorize the syrup and adsorb impurities (Section F). The syrup pH is between 4.0 and 5.0 entering and exiting this carbon bed and it has been found that any remaining weak organic acids are not adsorbed.

The fructose syrup is then passed through an ion-exchange system (Section G) to remove salts and other impurities remaining in the syrup. The use of a microporous adsorbent in this ion-exchange system will again delay the rollover from the anion exchange resin and thus improve the overall process efficiency.

The purified syrup is then either concentrated by evaporation (Section H) or again passed through a cation exchange resin to upgrade the syrup from 42% HFCS to 55% HFCS (Section I).

The instant invention, while described in the examples that follow by a preferred embodiment, is not intended to be limited to the use of activated carbon. For example, using adsorbents other than activated carbon at the low pH ion-exchange sites may also prevent the premature need for regenerating the anion exchange resin. Examples of other microporous adsorbents capable of adsorbing the acids responsible for titratable acidity and other solution impurities include: Ambersorb Macrorecticular Resins (Rohm & Haas Co.), Fuller's Earth and other microporous clays, zeolite sieves, silica gel, alumina, and the like.

EXAMPLE 1

A two inch diameter bed containing 12 g of acid washed PCB activated carbon (available from Calgon Corporation, Pittsburgh, Pa.) was inserted between a cation and anion exchange resin pair (see FIG. II).

Untreated dextrose syrup was run through the carbon containing system and the conductance breakthrough of the system was measured. Conductance of the solution was measured in 100 ml increments on a Cole-Parmer Model 1481-00 conductivity meter. The unit of conductance generally used in the sweetener industry are micromhos. Thus the conductance breakthrough plots show when (in terms of volume treated) an ion exchange resin system has ceased adsorbing ionic species contributing to solution conductivity. This conductance breakthrough was plotted against the conductance breakthrough of the same ion-exchange resin system without the carbon bed inserted. FIG. III shows these two curves. Curve A represents the untreated (no carbon) syrup while curve B represents the treated syrup. Assuming an arbitrary breakthrough point of 100 micromhos, an extension of anion resin lifetime of about 30 percent was shown as measured by the increased volume of syrup treated by the carbon containing system.

EXAMPLE 2

The carbon bed employed in Example 1 was regenerated using conditions conventionally used for regeneration of the anion exchange resin, i.e., caustic (NaOH) wash (about 2 wt%) followed by water rinse (to a pH of about 9.0). The conductance breakthrough test was repeated, as in Example I, using the regenerated PCB activated carbon and fresh supplies of cation and anion exchange resins. The conductance breakthrough curves shown in FIG. IV show an extension of anion resin of about 49%. This improvement over the virgin carbon is probably due to better wetting of the carbon bed following the caustic regeneration. Curve A represents an untreated (no carbon) system, curve B represents a virgin carbon system and curve C represents a regenerated carbon breakthrough cycle.

In addition to the two weight percent caustic wash employed in this Example, other caustic solutions such as $NH_4OH$, KOH, $Na_2CO_3$, $NaHCO_3$, $Ca(OH)_2$, $Mg(OH)_2$ and the like, may be employed so long as a high pH is attained. In addition to the water rinse described above, an acid rinse (neutralization) could be employed or a series of acid-water rinses or water-acid rinses could be employed.

EXAMPLE 3

Following the successful extensions of anion exchange resin lifetime on the dextrose side of the HFCS purification system, a similar experiment was run on the frustose side. The same conditions as used in the preceeding examples were used. FIG. V shows the breakthrough curves D, for the untreated anion effluent and E, for the carbon treated effluent. The extension factor here is smaller than that seen on the dextrose side of the process because most of the organic acids likely to interfere with the fructose side anion exchange resin have already been removed earlier in the processing.

The examples demonstrate the usefulness of the present invention. Using the figures shown on the conductance breakthrough curves as guides, expected extension of anion exchange resin lifetime for the dextrose side of a HFCS process would be on the order of about 25 to 50% or higher.

As described above, adsorption of the weak organic acids contributing to titratable acidity by microporous adsorbents will occur best at low pH. Low pH conditions exist within the cation exchange resin bed. Therefore a mixture of the cation exchange resin and activated carbon or another microporous adsorbent would also be expected to delay premature exhaustion of the anion exchange resin as does carbon treatment of the cation exchange resin effluent. Finally, a low pH condition also exists initially in the anion exchange bed. After some time passes, however, the anion exchange process raises the pH of the syrup within this anion bed. However, one could mix a microporous adsorbent with the anion exchange resin for additional protection of the anion bed. This placement would be the least desirable of those described, but, the concept would still apply. Mixtures of ion exchange resin (cation or anion) with the microporous adsorbent may vary from 1 percent by volume microporous adsorbent to 99 percent by volume microporous adsorbent. The quality of the adsorbent, that is, its adsorptive capacity will be a determinative factor. For activated carbons a preferred amount in a mixture with an ion exchange resin would be from 10 percent to 50 percent by volume carbon. The addition of acids (e.g., HCl, $H_2SO_4$, etc.) to the syrup to achieve a low pH condition is not generally a desirable alternative because the acid counter-ions would necessarily have to be removed by the anion exchange resin. This would reduce or eliminate the attempted extension of that resin's useful lifetime. However, in those cases where the impurities to be removed are of the highly pH sensitive type, the addition of an aqueous mineral acid (e.g. HCl, $H_2SO_4$, $H_3PO_4$, $HNO_3$ and the like) might be advantageous. Such a case would be the improved purification of the sweetener solution in which the pH shift through a cation resin would be insufficient to achieve significantly enhanced adsorption of pH sensitive species, or when practical engineering considerations preclude the use of a cation bed to lower the pH. This improved sweetener purification process employing the addition of acid is illustrated in Table I.

TABLE I 254 nm U.V. impurity Removal Efficiency from Dextrose Syrup
Column Breakthrough at 0.25 lbs. of carbon/100 lbs of sugar.

| pH | Percentage of Impurity removed |
|---|---|
| 4.6 | 26% |
| *3.0 | 39% |
| *2.5 | 51% |
| *2.0 | 60% |

*Ajusted with (12.0 molar) HCl.

A microporous adsorbent placed following a cation exchange resin could also precede a mixed cation/anion resin bed and serve as a useful adsorber of undesirable contaminants. For example, sweetener solution refineries may employ mixed cation/anion resin beds in their refining process. The use of a cation resin bed, followed by, for example, an activated carbon bed, would improve the sweetener solution purification by removing organics not adsorbed earlier in the processing, thus extending the lifetime of the mixed cation/anion resin system.

Based on the improved anion resin performance for sweetener applications, it is anticipated that under other conditions, a properly positioned microporous adsorbent could be used to enhance the performance of a cation exchange resin. For example, ion exchange resins used in the treatment of condensate water systems (boiler corrosion prevention) rely on a cation resin to remove weak organic bases from aqueous solutions and retain them as the positively charged species. Examples of typical weak organic bases include aniline, purine, pyridine, toluidine, quinoline and other common organic amines with $pk_a$ of greater than 7. These weak organic bases become less water soluble at high pH. Thus, at a system pH of at least 10, these bases could easily be removed by a microporous adsorbent, thus reserving the cation exchange resin for those materials not adsorbed, thereby extending its useful lifetime. To accomplish this extension, the solution being purified would initially enter an anion exchange resin, exiting at a high pH and then pass to the cation exchange resin. As described above, the microporous adsorbent could be (1) mixed with either of the ion-exchange beds or (2) placed between the beds as a separate adsorber.

What is claimed is:

1. A fructose syrup purification process consisting essentially of:

(a) passing fructose syrup through a bed containing a cation exchange resin, wherein the effluent from said cation exchange resin bed has a pH of from 2.0 to 2.5;

(b) passing the effluent of said cation exchange resin through a bed containing activated carbon, thereby adsorbing weak organic acids and other fructose syrup impurities; and (c) passing the effluent from said activated carbon bed through a bed containing an anion or a mixed cation-anion exchange resin.

2. The process of claim 1 wherein said activated carbon is granular.

3. The process of claim 1 wherein said activated carbon is powdered.

4. The process of claim 1 wherein said activated carbon is acid washed.

5. The process of claim 1 wherein said activated carbon has been regenerated using a caustic wash.

6. The process of claim 1 wherein the separate beds of cation exchange resin and activated carbon are eliminated and replaced by a single bed comprising a mixture of from 10 to 50 percent by volume activated carbon and 90 to 50 percent by volume cation exchange resin.

7. The process of claim 1 wherein the separate beds of anion exchange resin and activated carbon are eliminated and replaced by a single bed comprising a mixture of from 10 to 50 percent by volume activated carbon and 90 to 50 percent by volume anion exchange resin.

8. A dextrose syrup purification process consisting essentially of:

(a) passing dextrose syrup through a bed containing a cation exchange resin, wherein the effluent from said bed has a pH from 2.0 to 2.5;

(b) passing the effluent of said cation exchange resin through a bed containing activated carbon, thereby adsorbing weak organic acids and other dextrose syrup impurities; and (c) passing the effluent from said activated carbon through a bed containing an anion or a mixed cation-anion exchange resin.

9. The process of claim 8, wherein said activated carbon is granular.

10. The process of claim 8, wherein said activated carbon is powdered.

11. The process of claim 8, wherein said activated carbon is acid washed.

12. The process of claim 8, wherein said activated carbon has been regenerated using a caustic wash.

13. The process of claim 8, wherein the separate beds of cation exchange resin and activated carbon are eliminated and replaced by a single bed comprising a mixture of from 10 to 50 percent by volume activated carbon and 90 to 50 percent by volume cation exchange resin.

14. The process of claim 8, wherein the separate beds of anion exchange resin and activated carbon are eliminated and replaced by a single bed comprising a mixture of from 10 to 50 percent by volume activated carbon and 90 to 50 percent by volume anion exchange resin.

* * * * *

UNITED STATES PATENT AND TRADEMARK OFFICE

CERTIFICATE OF CORRECTION

PATENT NO. : 4,587,953

DATED : May 13, 1986

INVENTOR(S) : MICHAEL R. ROSENE

It is certified that error appears in the above-identified patent and that said Letters Patent are hereby corrected as shown below:

Column 1, line 8, after "June" delete "24" and substitute therefor -- 28 --; and Column 4, line 56, delete "frustose" and substitute therefor -- fructose --.

Signed and Sealed this

*Twenty-sixth* Day of *August 1986*

[SEAL]

*Attest:*

DONALD J. QUIGG

*Attesting Officer*

*Commissioner of Patents and Trademarks*